United States Patent [19]

Hosler

[11] Patent Number: 4,594,148

[45] Date of Patent: Jun. 10, 1986

[54] EXTRACTION OF AROMATICS WITH ETHYL ACETOACETATE

[75] Inventor: Peter Hosler, Wallingford, Pa.

[73] Assignee: Sun Refining and Marketing Company, Philadelphia, Pa.

[21] Appl. No.: 701,264

[22] Filed: Feb. 13, 1985

Related U.S. Application Data

[63] Continuation-in-part of Ser. No. 687,706, Dec. 31, 1984, abandoned.

[51] Int. Cl.[4] ..... C10G 21/16; C10G 21/28

[52] U.S. Cl. ..... 208/332; 208/321

[58] Field of Search ..... 208/321, 332; 585/833, 585/866

[56] References Cited

U.S. PATENT DOCUMENTS

| | | | |
|---|---|---|---|
| 2,960,548 | 11/1960 | Ayers et al. | 208/332 |
| 3,167,501 | 1/1965 | Woodle | 208/313 |
| 4,328,092 | 5/1982 | Sequeira, Jr. | 208/326 |

*Primary Examiner*—Andrew H. Metz
*Assistant Examiner*—Glenn A. Caldarola
*Attorney, Agent, or Firm*—J. Edward Hess; Donald R. Johnson; Stanford M. Back

[57] ABSTRACT

This invention relates to an energy efficient process for the solvent extraction of aromatic hydrocarbons from hydrocarbon streams containing the same, using as the solvent ethyl acetoacetate. This solvent may be recovered from the aromatics by cooling the aromatic/solvent mixture, whereby separation takes place without distillation.

15 Claims, 2 Drawing Figures

EXTRACTION OF AROMATICS WITH ETHYL ACETOACETATE

CROSS REFERENCE RELATED CASES

This application is a continuation-in-part of U.S. application Ser. No. 687,706 filed Dec. 31, 1984 in the name of Peter Hosler, and entitled "Extraction of Aromatics with Ethyl Acetoacetate", abandoned.

BACKGROUND OF THE INVENTION

1. Field of the Invention

This invention relates to an improved method for extracting aromatic hydrocarbons in high yields from mixed hydrocarbon feed streams containing the same. More particularly, this invention relates to a low-energy process for the solvent extraction of aromatic hydrocarbons from nonaromatic hydrocarbons, including naphthenic and paraffinic hydrocarbons, using as the solvent ethyl acetoacetate, and thereafter separating this solvent from the aromatic hydrocarbons utilizing minimum high-energy distillation means. The process is particularly applicable to the separation of aromatics from suitable mixed hydrocarbon streams in the preparation of lubricating oils.

2. Prior Art

The separation of aromatic from non-aromatic hydrocarbons to recover both aromatic feedstock such as benzene, xylene, toluene and the like, and non-aromatic hydrocarbons useful as lube oils, is well-known in the art. In almost all instances these processes have been directed to the use of solvents which selectively extract the aromatics from the mixed hydrocarbons, the differences in the prior art methods being principally involved with the choice of solvent which will remove those aromatics to thereby impart the most desirable characteristics to the resulting lubricating oil, such as viscosity, color, stability and the like by removal of as much of the aromatics as possible. Thus, one of the major objectives in the choice of a solvent is its ability to remove as many of the "undesirable" aromatics as possible to provide a lube oil with these highly desirable properties.

In addition to the selective extraction abilities of solvents, a major economic consideration in the choice of solvents and related methods is the ability of the solvent to be separated and recovered from the aromatic hydrocarbons in order that it could be recycled and reused in the extraction process. Thus, it has been a further major objective of the prior art methods to choose a solvent or class of solvents which could readily be recovered from the aromatic phase of the extraction process in the most economical way possible. These prior art solvent recovery methods, which have been characterized by the use of such solvent systems as phenols, furfural, N-methyl pyrrolidone, and the like combined with secondary techniques such as steam, or combination of solvents, have proved generally effective for the purposes intended. However, most if not all of them have been highly energy-intensive in that they have required at least one, and often more, heating and distillation steps, the distillation being the most energy-costly of all. Thus, it is also a major objective in the choice of a solvent that it be recoverable in as energy-effective a manner as possible.

A summary of the prior art which represents both the conventional, energy-intensive methods, and more energy-conservative methods, can be found in European Patent Office publications Nos. 43,267 and 43,685 (1982), the prior art discussions of which are incorporated herein by reference.

One example of a "low energy" process which is pertinent to the process of the present invention is disclosed in the above Euro. Pat. No. 43,267, in which, following a conventional extraction step with an aromatic-selective solvent to form a raffinate phase and an aromatic-rich solvent phase, the latter is cooled to further form an aromatic extract phase and a solvent phase, the solvent is recycled and the aromatic hydrocarbons are recovered. Further taught in this process is the possibility of using such solvents as N-methyl-2-pyrrolidone, and "anti-solvents" such as water, ethylene glycol, glycerine and the like in conjunction with the extraction procedure.

Euro. Pat. No. 43,685, also mentioned above, teaches a related "low-energy" process in which an aforementioned "anti-solvent" for the extracted aromatics, for example water, is added to the aromatic-rich solvent phase following extraction to promote separation of the aromatic and solvent phases.

Having regard for the above methods, it is thus an object of this invention to provide a low-energy process which will result in both highly effective selective extraction of aromatic hydrocarbons from mixed hydrocarbon streams containing the same to provide a lube oil of high quality, and at the same time a means for recovering the solvent without the expenditure of huge amounts of energy and/or equipment.

SUMMARY OF THE INVENTION

In accordance with the present invention, it has now been found that the foregoing objects can be achieved when there is employed as the solvent in the selective extraction of aromatics from mixed hydrocarbons containing the same, the compound ethyl acetoacetate.

The use of ethyl acetocetate as the solvent in the extraction process of this invention provides unexpected results in that while it shares the property common to all such solvents of being partially miscible with petroleum feedstocks, it also, unexpectedly, has exceptionally high miscibility at elevated temperatures, as described below, and at the same time has exceptionally low miscibility at low temperatures, as further described below. Thus, as will be seen below, these unique properties allow for a ready, energy-efficient separation of this solvent from aromatics without costly distillation methods.

Ethyl acetoacetate also has other desirable properties which provide additional advantages in this process, namely (1) it has good selectivity for aromatics; (2) it has only moderate volatility, thus minimizing solvent losses; (3) it has a high specific gravity which facilitates phase separation; and (4) it has low toxicity and is non-corrosive.

The liquid phase extraction process of the present invention thus comprises the steps of:

(a) contacting a mixed hydrocarbon feed containing aromatic and non-aromatic hydrocarbons in an extraction zone with the solvent ethyl acetoacetate at an elevated temperature to provide an aromatic-rich ethyl acetoacetate solvent phase containing said aromatic hydrocarbons, and a raffinate phase containing primarily non-aromatic hydrocarbons;

(b) recovering and cooling the aromatic-rich solvent phase to form an upper phase comprising an aromatic-rich extract containing solvent and aromatic hydrocarbons, and a lower solvent-rich phase containing primarily said ethyl acetoacetate and residual hydrocarbons; and (c) recovering the aromatic hydrocarbons and the raffinate.

In a preferred embodiment, as described in detail below, the ethyl acetoacetate solvent of step (b) above is desirably recycled to the extraction zone, thereby effecting substantial economies. In addition, most preferably, any residual solvent mixed in with the raffinate and the aromatic extract is also recovered by various methods described below and likewise recycled to the extraction zone.

In general, depending upon the uses to which the raffinate and aromatics are to be put, these two product streams may then be further treated to purify them.

DESCRIPTION OF THE PROCESS

In carrying out the process of this invention with the above described ethyl acetoacetate (hereinafter "solvent") many of the individual step-by-step operations and operating conditions will be understood by those skilled in the art as being within known ranges and expedients. However, the sequence of steps, the temperature ranges within which they are performed, and the ratio of components should be carefully observed when employing the solvent of this invention. Moreover, the exact treatment of the resulting product streams will be dependent upon the nature of the original feedstock, the degree to which the "individual" aromatics have been removed, and the particular use to which the final product streams are to be put.

As noted above, the feedstock to which this invention is particularly applicable are those mixed hydrocarbon feeds known in the art which contain aromatic, naphthenic, and paraffinic hydrocarbons wherein the non-aromatic component comprises mineral oils useful as lubricating oils. Typical feedstocks which may thus be suitably treated are those derived by vacuum distillation of crude oils, and generally boiling in the range of from about 350° to 600° C., preferably 380° to 550° C.

In general, subject to known engineering expedients, the aforedescribed process may desirably be carried out under the following conditions, which may be read in connection with FIGS. 1 and 2 their description thereof below.

The weight ratio of solvent to hydrocarbon feed in the extraction zone is desirably in the range of from about 1:1 to 4:1, and preferably 1.5:1 to 3:1, depending upon the exact nature of the feedstock. It should be noted that as contrasted with many prior art extraction solvents, including those of Euro. Pat. No. 43,267, the volume of solvent employed herein and recycled is quite low, thereby effecting substantial economies in materials and equipment.

The temperature in the extraction zone should be sufficiently elevated to effect significant extraction and will generally be greater than about 65° C., desirably 80° to 140° C., and preferably should be from about 90° to 130° C., while the pressure should be adequate to maintain a liquid phase extraction, desirably about 1 to 3 atm.

Again, each of the operating conditions can be varied in accordance with the exact nature of the feed, as known in the art. The extraction equipment may be of known, conventional design, for example, of the rotary disc contactor type containing a plurality of centrally mounted discs supplemented by pumps, etc. or arrangements of equivalent design. Other equipment such as coolers, heat exchangers, etc. are also of conventional design.

The raffinate phase and extract or solvent phases are removed separately from the extractor and processed further. The solvent is cooled in a cooling zone which causes a phase separation of aromatic rich extract and the solvent. In the cooling zone, the temperature should be low enough to effect phase separation, generally less than about 60° C., desirably 30° to 60° C., and preferably in the range of about 40° to 50° C., again depending upon the exact nature of the original feedstock. In this zone, the top layer, which is the aromatic extract, together with residual solvent, is decanted for further treatment to remove residual solvent, while the bottom layer, which is solvent together with residual hydrocarbons, is withdrawn and recycled to the extractor without the need for any further treatment.

Optionally, depending upon the nature of the feedstock and rigorousness of the extraction conditions, additional intermediate operations may be performed prior to final removal of any solvent from the raffinate or aromatic extract to obtain higher purity material. Thus, for example, the raffinate phase from the extractor may, if desired, be treated in a second extractor with a separate recovery system, as described below.

In a further optional mode, as discussed in detail below, either in combination with a second extraction zone or a single such zone, the raffinate may first be sent to an intermediate cooling zone prior to passing it to any solvent recovery tower in order to remove most of any residual solvent. In this cooling zone, which should be operated at below 60° C., and preferably from 40° to 50° C., there is formed an upper raffinate-rich phase and a lower solvent rich phase. The solvent may then be recovered and recycled to the extraction zone, while the raffinate is collected for further treatment, as desired.

After any intermediate treatment or purification, the aromatic extract ("extract oil"), which may contain small proportions of solvent up to 20%, admixed with it, is desirably further processed by steam or nitrogen stripping, vacuum distillation, or a combination thereof, to remove solvent for recycling to the extractor. After recovery, the aromatic extract oil may be further treated to refine and separate the same into desired fractions by known methods.

In a like manner, the raffinate recovered from the extraction (and intermediate) steps, which may contain a few percent of solvent remaining in it, may also be subject to additional treatment in a number of ways, depending upon the particular end use to which the raffinate is to be put. Thus, for example the raffinate may be processed by steam or nitrogen stripping, vacuum distillation, or a combination thereof.

It will thus be seen from the foregoing that the selective solvent of this invention has uniquely desirable properties in that it not only is a highly effective extraction solvent, but also, when cooled to temperatures below about 60° C., it separates out from the extracted aromatics in significant quantities sufficient for it to form a separate phase which can be withdrawn from the cooling zone or zones and recycled to the extractor without any heavily energy-dependent distillation step.

In an alternate embodiment of the invention, there may be employed, as described in detail with respect to FIG. 2, an additional extraction zone, or alternatively, a mixing plus settling zone, together with related separators, etc. This arrangement is useful in providing a feedstock and solvent of greater purity for the second extraction zone, and thus, ultimately a more pure raffinate. As will be recognized by those skilled in the art, a combination of a mixing tank for contact of the feed with the solvent, followed by a subsequent settling tank, has for practical purposes the same effect as an extraction tower.

In either event, after the first separation at elevated temperatures, the raffinate is withdrawn overhead and passed to the second extraction zone while the aromatic/solvent mixture is cooled and sent to a separator where an aromatic top layer and a solvent phase bottom layer are formed. The aromatic extract is taken off overhead to a recovery zone while the solvent is recycled to the mixing or extraction zone. The raffinate from this first stage may then be treated in the same way as described in FIG. 1 below, i.e., the process then proceeds with the raffinate substituting as the feed stream, thereby ultimately providing a purer raffinate product for use as a lube oil.

DESCRIPTION OF PREFERRED EMBODIMENTS

Figure 1:
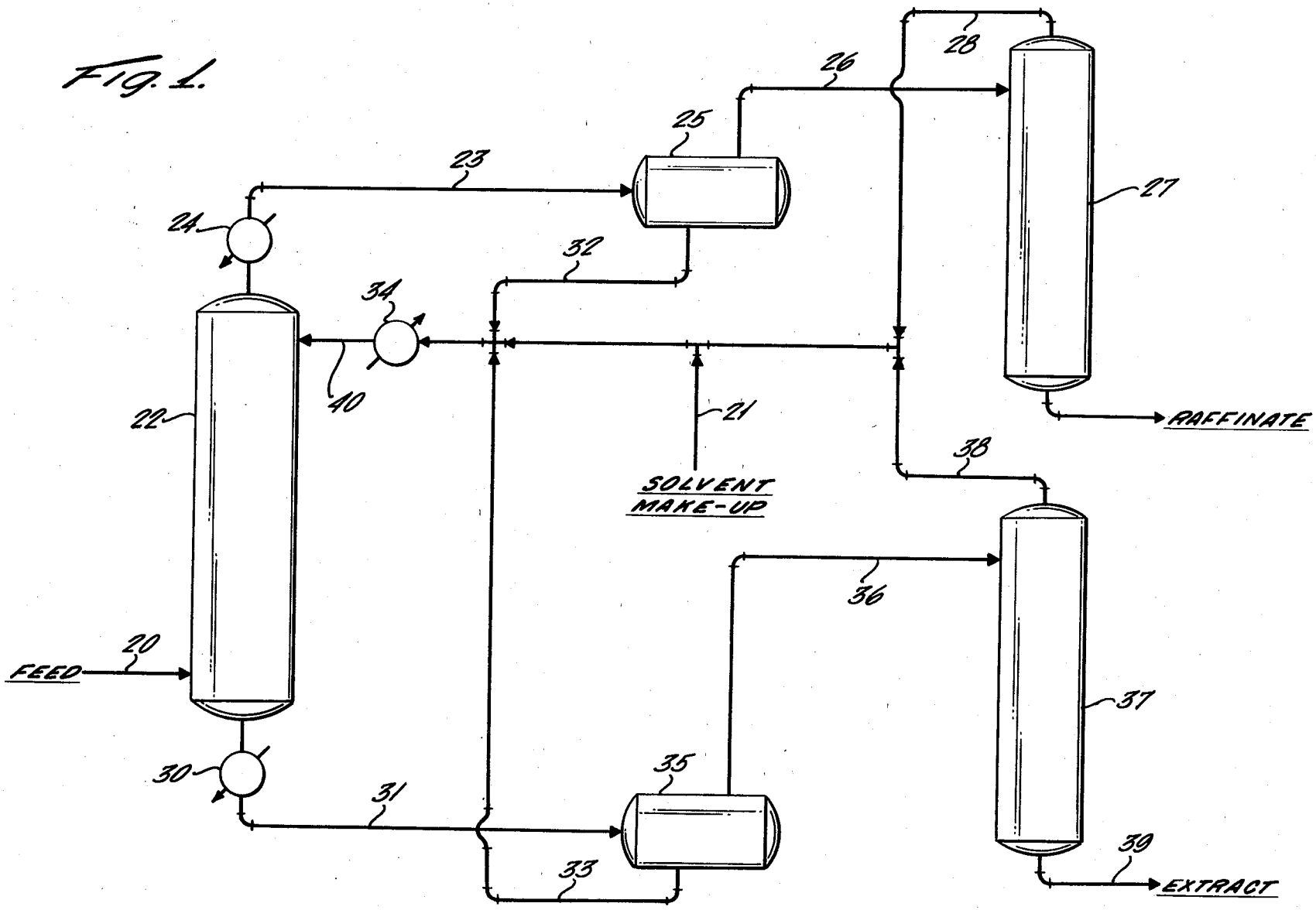
FIG. 1 is a schematic flowsheet illustrating one embodiment of the above-described invention.

In FIG. 1, a heated, mixed hydrocarbon feed containing aromatics, naphthenics and paraffinics is introduced through line 20 into the bottom of countercurrent extractor 22 where it is passed countercurrent to the solvent which is introduced into the top of the extractor via line 40 through makeup line 21 and recycle lines 28, 32, 33 and 38. The extraction zone temperature preferably should be in the range of from about 90° to 130° C., as a result of the solvent having been heated in heat exchanger 34, and the heated feedstream.

As a result of the extraction with the solvent the aromatics are substantially removed from the mixed feed, and the separated non-aromatic rich phase (raffinate) is removed overhead from the extractor through line 23 where it is further processed, if desired, by cooling in exchanger 24 and by phase separation in separator 25. The solvent separated from this step is suitable for recycle through line 32 to the extractor. The concentrated raffinate may then be passed through line 26 to recovery tower 27 for further processing, if necessary, and then withdrawn through line 29. Alternatively, the raffinate from the extractor may be sent directly to recovery tower 27 for solvent recovery, thus eliminating the need for an intermediate phase separator such as 25, and exchanger 24.

The aromatic-rich phase containing the solvent is recovered from the bottom of the extractor and passed through cooler 30 and line 31 into separator 35, where separation of the solvent and aromatic extract oil is substantially achieved. This separation is accomplished, as described above, by cooling the total mixture to a temperature of about 30° to about 60° C. until the extract oil, which is collected through overhead line 36 and passed into recovery tower 37, forms a top layer and is separated from the solvent. This solvent is then withdrawn through line 33 into heater 34, and then recycled to extractor 22.

It should be understood that this latter separation of aromatics and solvent in separator 35, which takes place by gravity, represents a significant advantage over the conventional, energy-intensive distillation methods of the prior art. In this separation, extract oil forms the top layer of the two phases which result from cooling the solvent/aromatic mixture, while the solvent forms the bottom layer. Each of these layers may then be withdrawn separately by conventional means and treated or recycled, as the case may be, as described above.

Further treatment of raffinate and extract oils to prepare them for final use may be effected in towers 27 and 37 respectively, and thereafter withdrawn from the bottom of these respective towers through lines 29 and 39.

In tower 27, the raffinate from the extractor may be vacuum distilled at about 100° C., and 100mm Hg absolute pressure, in order to remove any residual solvent admixed therein, generally no more than about 5 to 15 percent by weight. Alternatively, the raffinate may be contacted with steam or nitrogen in order to strip the solvent for recycle. After recovery from the raffinate, the solvent may be recycled to the extractor through overhead line 28. These methods, i.e. vacuum, nitrogen and steam stripping, are conventional separation/recovery expedients which may be applied routinely by those skilled in the art.

The aromatic extract oil recovered from separators 35, and which may contain up to 20 percent by weight of solvent, generally from 5 to 10 percent, may then be passed through line 36 to be vacuum distilled in tower 37, where the residual solvent is further separated from the aromatic extract and recycled through lines 38 and 40 through exchanger 34 to the extractor. Alternatively, the further separation of the residual solvent may be achieved by steam stripping, which may be followed by vacuum distillation to remove the water.

AN ALTERNATE EMBODIMENT

Figure 2:
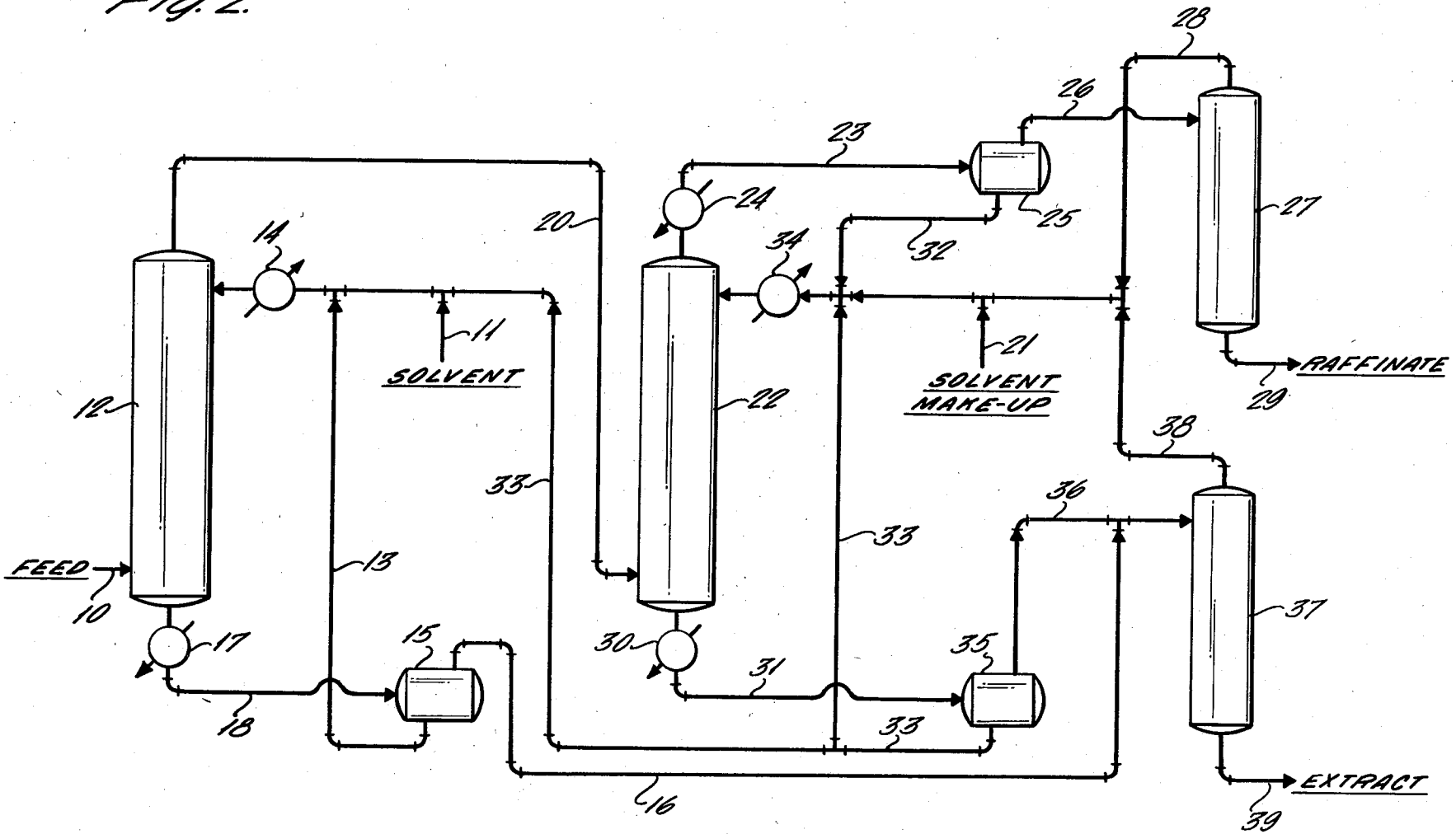
FIG. 2 is a schematic flowsheet illustrating an alternate embodiment of the invention which includes an additional extraction zone and related separators, as described in further detail below.

FIG. 2 describes one of many possible alternate embodiments of the above-described process for extracting aromatics from mixed hydrocarbon feedstocks for purposes of obtaining lube oils, using the solvent of this invention. Thus, if a higher purity raffinate with a higher viscosity index is desired, a staged operation may be conducted as shown in this figure.

In this case, a first extraction zone 12, and first separator 15, may be employed in combination upstream to the above-described extractor 22. The raffinate from first extractor 12 may then be introduced into the bottom of the second extractor 22 through line 20 instead of the feedstock that was introduced through line 20 in FIG. 1. Thereafter, the process is the same as described with reference to FIG. 1. The purpose of this added combination of steps is to provide an improved raffinate as a feedstock to extractor 22, and thus, ultimately a purer raffinate product.

In this embodiment, it will be understood that in yet a further variation of this scheme a contacting zone comprising a mixer and settler may be substituted in place of extractor 12 whereby the solvent recycle from separator 15 to the mixing zone would be employed.

In FIG. 2, the feedstock is introduced into extractor 12 through line 10, where it is mixed with solvent from line 11 and recycle lines 13, and 33 via heater 14. Extractor 12 operated at temperature of from about 65° to about 140° C., preferably, 90° to 130° C. as a result of the heated feedstream and heated solvent from heater 14. In the first extractor 12 two phases are formed by gravity, the top phase being primarily raffinate mixed with some solvent, while the bottom phase is primarily an aromatic extract and solvent mixture. The raffinate, as afore-described, is withdrawn overhead and introduced into the second extraction zone 22 for further processing as in FIG. 1.

The aromatic extract/solvent mixture is then withdrawn through line 18 via cooler 17, where it is adjusted to a temperature of from about 30° to 60° C., and then introduced into first separator 15. At this cooler temperature, as described above in FIG. 1 with respect to separator 35, the aromatic extract and solvent separate into two phases, rather than having to be distilled. The extract is then fed into recovery tower 37 (together with extract oil from separator 35) through line 16, while the solvent is recycled through line 13.

EXAMPLES

This invention will now be illustrated by, but not limited to, the following examples, in which, in Example 1, the process is carried out in a batch-wise fashion, and in Example 2, a continuous process. It should be noted that Examples 3 to 14 are comparative examples in which it is demonstrated that the closely related methyl acetocetate and many other solvents known in the art fail to give significant phase separation of the magnitude observed with ethyl acetoacetate.

EXAMPLE 1

One hundred parts by weight of feedstock, described in Table I, was combined with 170 parts by weight of ethyl acetoacetate in a laboratory separatory funnel. The mixture was heated to 121° C., shaken, and allowed to settle. The top layer was vacuum-distilled to remove solvent, and yielded 67 wt. % of a raffinate oil having a viscosity index (VI) of 77. The bottom layer was cooled to 38° C., which formed two phases. The top phase was 95 wt. % hydrocarbon oil and 5 wt. % solvent. When vacuum distilled it yielded light extract oil ("light extract"), 26 wt. % of the charge. The bottom phase ("heavy extract") was 95 wt. % solvent, and 5 wt. % hydrocarbon oil.

Thus it is seen from the analysis given in Table I that a feedstock of 52 VI containing 19 wt. % aromatic carbons, can be selectively extracted in one stage to give 67 wt. % raffinate of 77 VI containing 16 wt. % aromatic carbons. Further, the aromatic extract can be essentially separated from the extraction solvent by decantation at moderate temperatures, rather than by distillation, and the solvent recovered from this decantation step is suitable for recycle.

TABLE I

| | ASTM Method | Charge | Raffinate | Light Extract | Heavy Extract |
|---|---|---|---|---|---|
| Yield (wt %) | | 100 | 67 | 26 | 7 |
| PROPERTIES: | | | | | |
| Viscosity (cST @ 98.9° C.) | D-445 | 19.24 | 15.84 | 24.67 | 66.73 |
| Density (@60° C., kg/dm$^3$) | D-1298 | .9128 | .8918 | .9401 | 1.0122 |
| Refractive Index (60° C.) | D-1747 | 1.5044 | 1.4946 | 1.5097 | 1.5784 |
| Viscosity Index | D-2270 | 52 | 77 | 21 | negative |
| Viscosity-Gravity Constant | D-2501 | .877 | .852 | .909 | .989 |
| CARBON-TYPE COMPOSITION: | D-2140 | | | | |
| Aromatic Carbons (wt %) | | 19 | 16 | 17 | 47 |
| Naphthenic Carbons (wt %) | | 35 | 28 | 57 | 29 |
| Paraffinic Carbons (wt %) | | 46 | 56 | 26 | 24 |
| DISTILLATION, °C. | D-1160 | | | | |
| Initial | | 358 | | | |
| 5% | | 430 | | | |
| 10% | | 455 | | | |
| 30% | | 484 | | | |
| 50% | | 502 | | | |
| 70% | | 521 | | | |
| 90% | | 549 | | | |
| 95% | | 558 | | | |

EXAMPLE 2

The following pilot-scale extraction illustrates a continuous extraction operation as shown in FIG. 1, and contains calculations based on batch-scale data obtained in Example 1. A single-stage extractor is used for purposes of this example, although it is understood that a multiple-stage extractor would be more selective for aromatics removal, giving a raffinate product of higher viscosity index. In this example, a feedstock of the quality given in Table I is extracted under the following conditions:

| | |
|---|---|
| Extraction temperature | 121° C. |
| Extraction rates: | |
| Feedstock | 100 kg/hr |
| Ethyl Acetoacetate | 173 kg/hr |
| Decantation temperature | 38° C. |

When such an extraction is carried out, stream compositions for the above extraction, as shown in Table II, are obtained.

TABLE II

STREAM COMPOSITIONS FOR EXAMPLE 2 (Kg/Hr)

| | Feed | Solvent | Extraction Raffinate | Concentrated Raffinate | Recovered Solvent | Raffinate Product |
|---|---|---|---|---|---|---|
| Stream Number (FIG. 1) | 20 | 40 | 23 | 26 | 28 | 29 |

TABLE II-continued

| STREAM COMPOSITIONS FOR EXAMPLE 2 (Kg/Hr) | | | | | | |
|---|---|---|---|---|---|---|
| COMPOSITION: | | | | | | |
| Hydrocarbon | 100 | 7 | 67 | 67 | nil | 67 |
| Ethyl Acetoacetate | 0 | 173 | 12 | 3 | 3 | 0 |
| | Aromatic Extract | Solvent | Solvent | Aromatic Concentrate | Recovered Solvent | Extract Product |
| Stream Number (FIG. 1) | 31 | 32 | 33 | 36 | 38 | 39 |
| COMPOSITION: | | | | | | |
| Hydrocarbon | 40 | nil | 7 | 33 | nil | 33 |
| Ethyl Acetoacetate | 161 | 9 | 158 | 3 | 3 | 0 |

From the above it will be seen that selective extraction of aromatics can be obtained at a mild extraction temperature and low solvent ratio, which conditions are a significant improvement over those used in current commercial extractions for making lubricating oils.

In the above example, out of 173 kg/hr total solvent, about 167 kg/hr of solvent may be recovered for recycle by the energy-efficient phase separation of this invention, while only about 6 kg/hr of the total 173 kg/hr is obtained by conventional distillation for recycle. Stated in another manner in this invention, usually over 70% by weight, preferably over 80%, more preferably over 90% of the solvent is recovered by the cooling, i.e., the non-distillation step.

The energy savings of this process is illustrated by the following comparison with, for example, furfural. In this comparison, the higher solvent ratio with furfural inherently will require more heat but this higher ratio is necessary to achieve equivalent separation with the two solvents.

| | Ethyl Acetoacetate | Furfural |
|---|---|---|
| Feedstock (kg/hr) | 1.0 | 1.0 |
| Solvent weight ratio | 1.73 | 3.0 |
| Solvent distilled (kg/hr) | 0.06 | 3.0 |
| Heat of vaporization (cal/gm) | 102 | 108 |
| Sub-total (kcal/kg feed) | 6.1 | 324. |
| Sensible heat (exchanger 34): | | |
| Solvent & hydrocarbon (kcal/kg feed) | 47.5 | |
| Total heat (kcal/kg feed) | 53.6 | 324. |

Thus it is seen that the total energy requirements of this system is about one-sixth the energy requirement of a conventional lubricating oil extraction process.

EXAMPLES 3–14

The following examples illustrate the unusual temperature-dependent solubility of petroleum oils in ethyl acetoacetate. One hundred parts by volume of the chargestock described in Table I was mixed successively with 250 parts by volume of various solvents. The mixtures were heated to 104° C. in a laboratory separatory funnel, shaken, allowed to settle, and decanted. The bottom extract layer was withdrawn and sampled for analysis by gas chromatography to determine the percent of feedstock extracted. This extract layer was then cooled to 38° C., which allowed the formation of a hydrocarbon-rich phase on top, and a solvent-rich phase on the bottom. Both of these phases were analyzed by gas chromatography to determine the distribution of the hydrocarbon extract that was obtained by the phase separation. The results are shown in Table III below.

TABLE III

| Ex | Solvent | A Aromatics Extracted at @ 104° C. (wt % of chg.) | B Aromatics Released By Phase Separation at 38° C. (Wt. % of charge) | C Aromatics Remaining in Solvent at 38° C. (Wt % of charge) | D Ratio B/C |
|---|---|---|---|---|---|
| 3 | Ethyl acetoacetate | 32.8 | 25.9 | 6.9 | 3.8 |
| 4 | Methyl acetoacetate | 23.0 | 0.7 | 22.3 | 0.03 |
| 5 | Triethylene glycol | 7.0 | 1.8 | 5.2 | 0.34 |
| 6 | Furfural | 41.7 | 10.1 | 31.6 | 0.32 |
| 7 | N—Methyl-2-pyrrolidone | 62.3 | 3.0 | 59.3 | 0.05 |
| 8 | N—Cyclohexyl-2-pyrrolidone | miscible | — | — | — |
| 9 | N—Hydroxyethyl-2-pyrrolidone | 11.0 | 2.7 | 8.3 | 0.33 |
| 10 | Acetyl butyrolactone | 15.3 | 0.6 | 14.7 | 0.04 |
| 11 | Acetyl acetone | miscible | — | — | — |
| 12 | Diacetone alcohol | 73.9 | 31.7 | 42.2 | 0.75 |
| 13 | Sulfolane | 10.4 | 0.4 | 10.0 | 0.04 |
| 14 | Sulfolene | 7.5 | nil | 7.5 | nil |

An extraction solvent should desirably dissolve a large amount of aromatics, 20% or more, to minimize the amount of solvent required. Column A (above) represents this value, in which commercial solvents such as furfural or N-methyl-2-pyrrolidone dissolve substantial quantities of aromatics. For the purpose of this novel energy-efficient procedure, it is also desired that a major portion of the dissolved aromatics form a separate phase upon cooling. It is seen from Examples 3 to 14 that ethyl acetoacetate has the combination of two desired properties not previously recognized in the art, namely, a very high capacity for dissolving aromatics at moderately high temperature (104° C.), and a low solubility for aromatics at low temperatures (38° C.), as shown in Column C. These temperatures, it should be noted, are in accordance with accepted commercial practice in this field.

Column B indicates the aromatics that are released directly by the phase separation process, while column C indicates the aromatics that must be recycled for further extraction before release. The ratio of column B to column C, shown in column D thus indicates relative effectiveness of these solvents at commercial temperatures, in which the ratio of B/C, as defined by Table III, represents the ratio of aromatics released by phase separation relative to the aromatics remaining in the solvent at those temperatures. On the basis of these comparisons, ethyl acetoacetate may be thus defined as having such a ratio which is greater than about 1, preferably greater than about 2, and most preferably, depending upon conditions employed, greater than about 3. Put somewhat differently, Table III shows that surprisingly, ethyl acetoacetate is at least 5–10 times more effective than other solvents listed, due to its novel and unexpected properties.

What I claim is:

1. A liquid phase extraction process for the dearomatization of a mixed hydrocarbon feed containing aromatic and non-aromatic hydrocarbons comprising:

(a) contacting the mixed feed in an extraction zone with the solvent ethyl acetoacetate at an elevated temperature to provide an aromatic-rich ethyl acetoacetate solvent phase containing said aromatic hydrocarbons, and a raffinate containing primarily non-aromatic hydrocarbons;

(b) recovering and cooling the aromatic-rich solvent phase to form an upper phase comprising an aromatic-rich extract containing solvent and aromatic hydrocarbons, and a lower solvent-rich phase containing primarily said ethyl acetoacetate, and residual hydrocarbons; and (c) recovering the aromatic hydrocarbons and the raffinate.

2. The process of claim 1 wherein the ethyl acetoacetate of step (b) is recycled to the extraction zone.

3. The process of claim 1 wherein any residual solvent in the raffinate and aromatic extract is removed and recycled to the extraction zone.

4. The process of claim 1 wherein the temperature in step (a) is from about 65° to 140° C.

5. The process of claim 1 wherein the temperature in step (b) is from about 30° to about 60° C.

6. The process of claim 1 wherein the weight ratio of solvent to feed in the extraction zone of step (a) is in the range of from about 1:1 to about 4:1.

7. The process of claim 1 further comprising (1) first contacting said mixed hydrocarbon feed with said solvent in a separate contacting zone upstream to the extraction zone of step (a) to form a raffinate containing primarily non-aromatic hydrocarbons, and an aromatic-rich solvent phase; and (2) separating said raffinate and introducing it into said extraction zone of step (a) instead of said mixed hydrocarbon feed.

8. The process of claim 7 wherein the contacting zone comprises a combination of a mixing and a settling zone.

9. The process of claim 7 wherein the contacting zone comprises an extraction zone.

10. The process of claim 7 further comprising (1) recovery and cooling said aromatic-rich phase to form a solvent phase and an aromatic extract phase, and recovering said aromatic extract; and (2) recycling said solvent to said contacting zone.

11. A liquid phase extraction process for the dearomatization of a mixed hydrocarbon feed containing aromatic and non-aromatic hydrocarbons comprising:

(a) contacting the mixed feed in an extraction zone with the solvent ethyl acetoacetate at an elevated temperature to provide an aromatic-rich ethyl acetoacetate solvent phase containing said aromatic hydrocarbons, and a raffinate containing primarily non-aromatic hydrocarbons;

(b) recovering and cooling the aromatic-rich solvent phase to form an upper phase comprising an aromatic-rich extract containing solvent and aromatic hydrocarbons, and a lower solvent-rich phase containing primarily said ethyl acetoacetate and residual hydrocarbons;

(c) recycling the ethyl acetoacetate to the extraction zone;

(d) separating any residual ethyl acetoacetate from the raffinate and aromatic extract, and recycling this solvent to the extraction zone; and (e) recovering the aromatic hydrocarbons and the raffinate of steps (a), (b), and (d).

12. The process of claim 11 further comprising (1) recovering and cooling the raffinate of step (a) prior to step (d) to form a raffinate-rich phase and a solvent-rich phase; and (2) recycling the solvent-rich phase to the extraction zone.

13. The process of claim 11 wherein the temperature in step (a) is from about 65° to 140° C.

14. The process of claim 11 wherein the temperature in step (b) is from about 30° to 60° C.

15. The process of claim 11 wherein the weight ratio of solvent to feed in the extraction zone of step (a) is in the range of from about 1:1 to about 4:1.

* * * * *